US007047578B2

(12) United States Patent
Spanton

(10) Patent No.: US 7,047,578 B2
(45) Date of Patent: May 23, 2006

(54) MEDICAL TRANSPORT TECHNOLOGY

(75) Inventor: John Spanton, Centuria, WI (US)

(73) Assignee: Vision, Rush City, MN (US)

( * ) Notice: Subject to any disclaimer, the term of this patent is extended or adjusted under 35 U.S.C. 154(b) by 0 days.

(21) Appl. No.: 10/761,878

(22) Filed: Jan. 21, 2004

(65) Prior Publication Data

US 2004/0244108 A1 Dec. 9, 2004

Related U.S. Application Data

(63) Continuation of application No. 10/278,187, filed on Oct. 24, 2002, now abandoned.

(51) Int. Cl.
*B66F 11/00* (2006.01)

(52) U.S. Cl. ..... 5/81.1 R; 5/81.1 HS; 414/921

(58) Field of Classification Search ..... 5/81.1 R, 5/81.1 RP, 81.1 HS, 625–626; 414/528, 414/921

See application file for complete search history.

(56) References Cited

U.S. PATENT DOCUMENTS 3,418,670 A 12/1968 Morgan
3,654,644 A * 4/1972 Stevens ..... 5/81.1 C
3,724,005 A 4/1973 Stevens
4,967,427 A 11/1990 Cherepy, Sr.
6,408,466 B1 6/2002 Blotta

* cited by examiner

*Primary Examiner*—Heather Shackelford
*Assistant Examiner*—Fredrick Conley
(74) *Attorney, Agent, or Firm*—Skinner and Associates

(57) ABSTRACT

A apparatus such as a stretcher or guerney, and method, for engaging acquiring and transporting an injured person or some other person or object. The apparatus comprises a base, housing or frame having a low clearance portion; a first conveyance assembly movably connected to the housing for moving the housing with respect to the ground or another base surface; a second conveyance assembly movably connected to the housing for moving the person or object with respect to the housing; and a power member for moving the first and second conveyance assemblies. The apparatus is liftable by other persons to transport the person or object to another location. The method comprises the steps of moving a housing having a low clearance portion so that the low clearance portion moves toward and under the person or object; and moving the person or object relative to the housing. The device and method are mechanized and substantially automated. The device moves so that the person or object remains stationary during loading.

15 Claims, 16 Drawing Sheets

MEDICAL TRANSPORT TECHNOLOGY

CROSS-REFERENCE TO RELATED APPLICATIONS, IF ANY

This application is a continuation of U.S. patent application Ser. No. 10/278,187 now abandoned, filed Oct. 24, 2002, which is hereby incorporated by reference.

37 C.F.R. §1.71(e) AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to human medical devices and methods. More particularly, the invention relates to an emergency medical transport device and method. Most particularly, the invention relates to an emergency medical transport device for engaging and acquiring an injured person such as an injured athlete or accident victim who is suspected of having a neck or spinal injury, without the necessity of lifting the injured person. The apparatus and methods of this invention may be applicable to other fields such as veterinary medical, materials handling, and the like.

2. Background Information

The state of the art includes stretchers, gurneys and boards.

U.S. Pat. No. 3,418,670 issued Dec. 31, 1968 to Morgan discloses a roller stretcher with a pair of endless belt which are wound over respective upper and lower guides. A driving mechanism rotates one of the guides sot that one of the belts is moved. The belts are in frictional contact with each other whereby the non driven belt is moved by frictional contact with the driven belt. The stretcher has a complicated structure. Replacement of belts is difficult and time consuming. And, slippage can occur as a result of the frictionally coupled belts. Slippage can compromise the comfort and safety of the patient being transported.

The background art are includes U.S. Pat. No. 3,724,005 issued Apr. 3, 1973 to Stevens which discloses a stretcher with an endless belt-cable or chain system which utilizes a non-endless belt which is coupled at both of its ends to a non-endless cable or chain. The non-endless belt is alternately wound and unwound around drums to move a patient. The background art also includes U.S. Pat. No. 6,408,466B1 issued Jun. 25, 2002 to Blotta which discloses a stretcher for the non-traumatic transport and lifting of people. It has a frame with beams with toothed bars, an inclined plate between the frame, a flexible sheet around the plate. A driving base moves the bars and causes the inclined plate to move.

This technology is believed to have significant limitations and shortcomings, including but not limited to, that they require lifting, sliding, rolling or otherwise moving an injured person onto the device for transportation.

For this and other reasons, a need exists for the present invention.

This invention provides a medical transport apparatus for an injured person which is believed to fulfil the need and to constitute an improvement over the background technology.

BRIEF SUMMARY OF THE INVENTION

The present invention provides an apparatus and method for acquiring and transporting an injured person.

In one aspect, the invention provides a device or apparatus for engaging, acquiring and transporting an object, particulary a person, and most particularly an injured person comprising:

a. a base, housing or frame having a low clearance portion;

b. a first conveyance assembly movably connected to the base for moving the base with respect to the ground;

c. a second conveyance assembly movably connected to the base for moving the person with respect to the frame; and d. a driver mechanism for driving the conveyance assemblies.

In another aspect, the invention provides a method of acquiring and transporting an object, particulary a person and most particularly an injured person, comprising the steps of:

a. moving a base or housing having a low clearance portion so that the low clearance portion moves toward and under the person; and b. moving the person relative to the base.

Advantages and features of the invention include but are not necessarily limited to that the device and method are mechanized and substantially automated, that the device moves so that the patient remains stationary during loading, and that the device and method are easy and safe for the operator(s) and the patient. The apparatus and method do not require lifting, sliding, rolling the injured person onto the device for transportation.

The features, benefits and objects of this invention will become clear to those skilled in the art by reference to the following description, claims, if any, and drawings.

DETAILED DESCRIPTION

The present invention provides an apparatus and method for engaging, acquiring and transporting an injured person. Example embodiments of the medical transport apparatus of the present invention are illustrated.

The device is mechanized and substantially automated. The device and method function by moving so that a patient remains stationary during loading. Although the description of the apparatus and method of the invention are in terms of an injured person, it is within the purview of the invention that the apparatus and process may be used with a non-injured person (for example elderly or restrained persons), animals or objects.

The benefits of the invention include, but are not necessarily limited to that the apparatus and method do not require lifting, sliding, or rolling the injured person onto the device for transportation.

Figure 1:
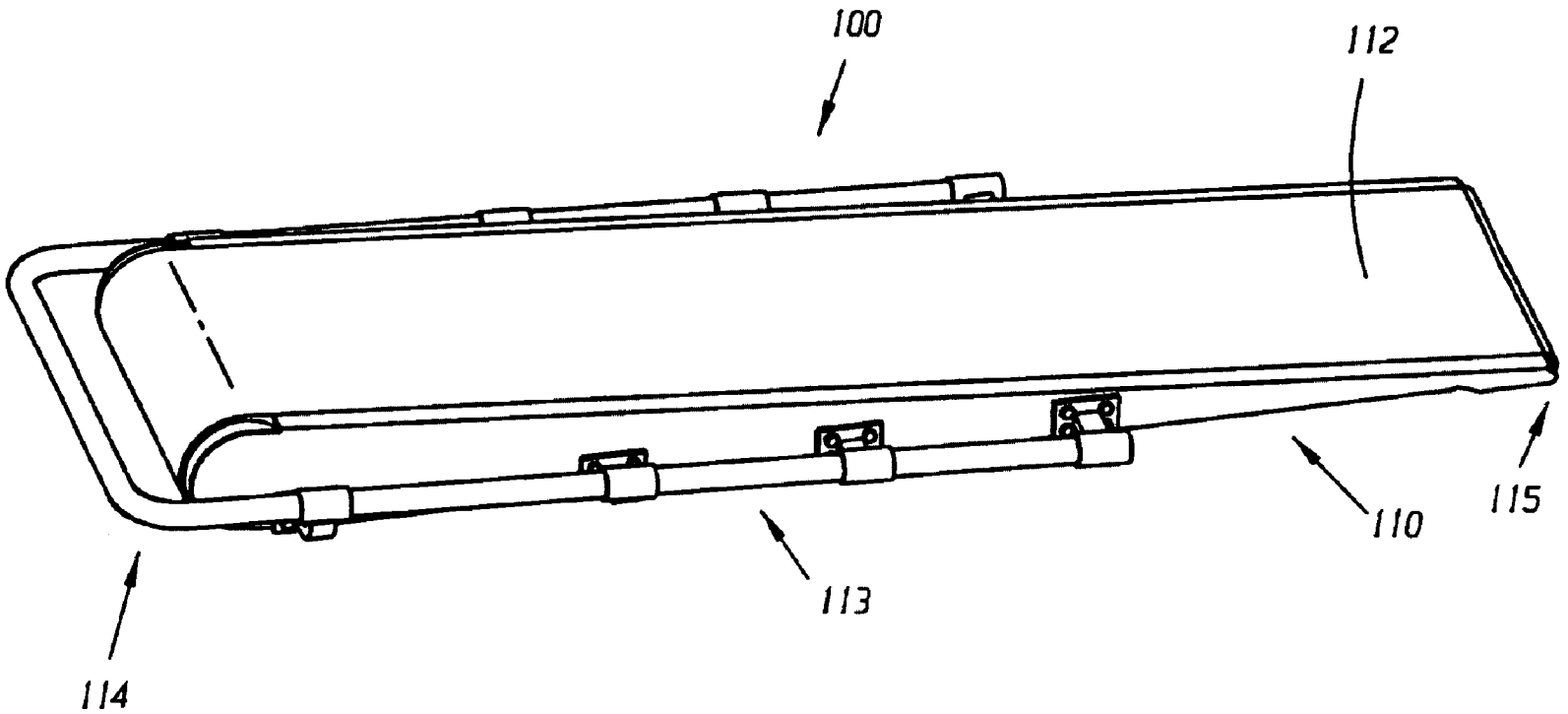
FIG. 1 is a perspective view of one embodiment of the medical transport apparatus of the invention.

Referring to FIG. 1, one embodiment of the medical transport device 100 comprises a base or housing 110, a top belt 112, a bottom belt 113 and a handle 114. The base 110 preferably has a rectangular configuration as viewed from the top, with a front end 115 and a back end 116.

Figure 3:
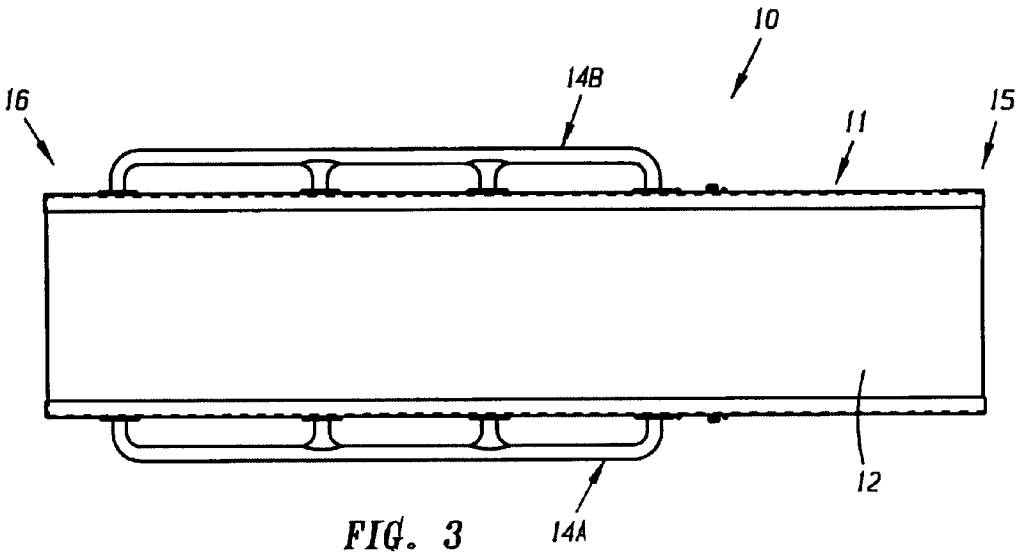
FIG. 3 is a top or plan view of the medical transport apparatus of FIG. 2.
Figure 2:
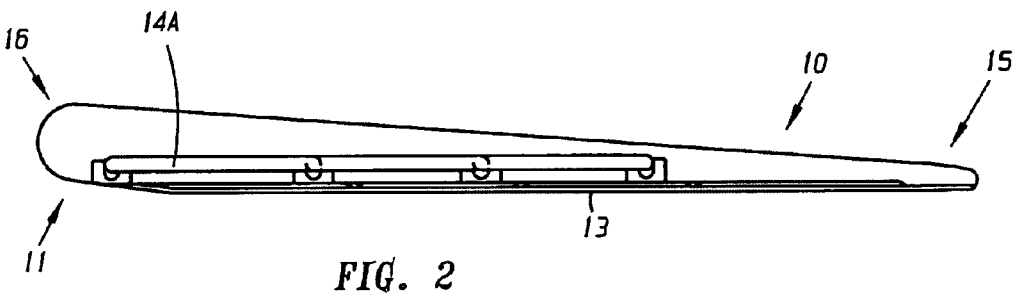
FIG. 2 is a side elevation view of another embodiment of the medical transport apparatus.
Figure 4:
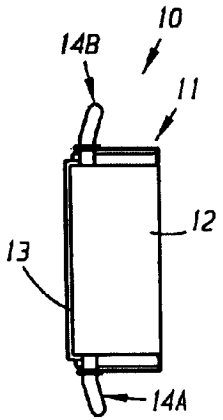
FIG. 4 is an end elevation view of the medical transport apparatus of FIG. 2.

Referring to FIGS. 2–4, another embodiment of the medical transport device which is substantially similar to the embodiment shown in FIG. 1. The device 10 comprises a base or housing 11, a top belt 12, a bottom belt 13 and a handle 14. The base 11 preferably has a rectangular configuration as viewed from the top, with a front end 15 and a back end 16. The base 11 has a preferred approximate length of 74 in. and width of 25 in. The front end 15 has a low profile and is disposed low to the ground so that the device 10 has approximate front height of ⅝ in. The base 11 provides an incline to a height at the back end 16 of about 6 in.

The top belt 12 is operatively connected to the frame 11. The top belt 12 is an endless belt with a longitudinal, top travel length substantially equivalent to the length of the base 11. It is preferably constructed of a flexible, polymeric material such as a food grade nylon backed rubber belt. The top belt 12 rotates in a counterclockwise direction as viewed in FIG. 2 and at a preferred predetermined speed of approximately 0.133 feet per second. This permits loading of a 6 foot tall person in approximately 45 seconds. The top belt 12 moves a patient (not shown) from the front end 15 towards the rear end 16. The bottom belt 13 also has and endless configuration and is operatively connected to the base 11. It has a longitudinal, bottom travel length of about ⅔ the length of the base 11. The bottom belt 13 is preferably constructed of a flexible, polymeric material. The material is preferably the same as the top belt 12. The bottom belt 13 preferably has a tred pattern on its outer face for surface traction. The bottom belt 13 rotates in a clockwise direction as viewed in FIG. 2, and perferably at a predetermined speed which is idential to that of the top belt 12 for a smooth contact loading force. Alternatively the speed can be changed to permit compression or decompression of a patient during loading. The speed may also be variable.

The bottom belt 13 engages the ground or another such surface or substrate, and moves the medical transport device 10 toward and under the patient simultaneously as the top belt 12 engages the patient and moves the patient onto the device 10. Although the patient is typically loaded head first, loading may be accomplished feet first. Unloading of a patient is accomplished by running the device 10 belts 12 and 13 in reverse. The patient is thus gently loaded and unloaded without lifting or manipulating the patient. Although the top and bottom belts 12 and 13 are shown and described as single structures, it is within the purview of the invention that they may be constructed as plural structures disposed side by side, and connected or not connected to each other.

The handles 14*a* and *b* are connected to the base 11 and provides a means of moving the patient transport device into a position for loading and unloading a patient, and for moving the patient when he or she is disposed on the device 10. The handles 14*a* and *b* are preferably disposed on the sides of the base 11 and extend from near the rear end 15 approximately ⅔ the length of the device 10. However, the handle 14 may have a longer length. Also, the handle 14 may have a unitary configuration and extend around the rear end 15 of the device 10. After loading of the patient, the device 10 may lifted by one or more users to transport the patient to another location such as an ambulance, helicopter, or other emergency vehicle or craft, a clinic or a hospital. The device is preferably light in weight and constructed of light weight materials.

Referring also to FIGS. 5–9, the base or housing 11 preferably comprises a frame 18, at least two upper rollers 19 and 20, at least two lower rollers 22 and 23, and a drive mechanism 25. The rollers 19, 20, 22 and 23 in combination with the belts 12 and 13 define conveyance assemblies or mechanisms. Upper drive roller 19 is disposed proximate the rear end 16 of the apparatus 10 and arranged laterally with respect to the overall elongated apparatus 10. It has a cylindrical configuration with a predetermined diameter. Upper idler roller 20 is disposed proximate the front end 15 of the apparatus 10 and arranged laterally. It has a cylindrical configuration and a predetermined diameter less than that of the upper drive roller 19 whereby the apparatus 10 front end 15 has a low profile. Referring also to FIGS. 9–12, the inner surface of top belt 12 is wrapped around upper drive roller 19, the belt glide bed 31, and upper idler roller 20. The outer surface of top belt 12 is engaged by an upper tensioning belt 21 disposed proximate upper drive roller 19.

The inner surface of bottom belt 13 is wrapped around lower drive roller 22, lower intermediate idler rollers 24*a* and *b*, and lower front end idler roller 24. Lower drive roller 22 is disposed proximate the rear end 16 of the apparatus 10 and arranged laterally. It has a cylindrical configuration with a predetermined diameter. Lower front end idler roller 23 is disposed toward the front end 15 of the apparatus 10, a predetermined distance from the lower drive roller 22, and arranged laterally. It has a cylindrical configuration and a predetermined diameter less than that of the lower drive roller 22 whereby the apparatus 10 front end 15 has a low profile. Intermediate lower idler rollers 24*a* and *b* are arranged laterally and parallel to each other a predetermined distance apart.

Figures 5, 6, 7, 8:
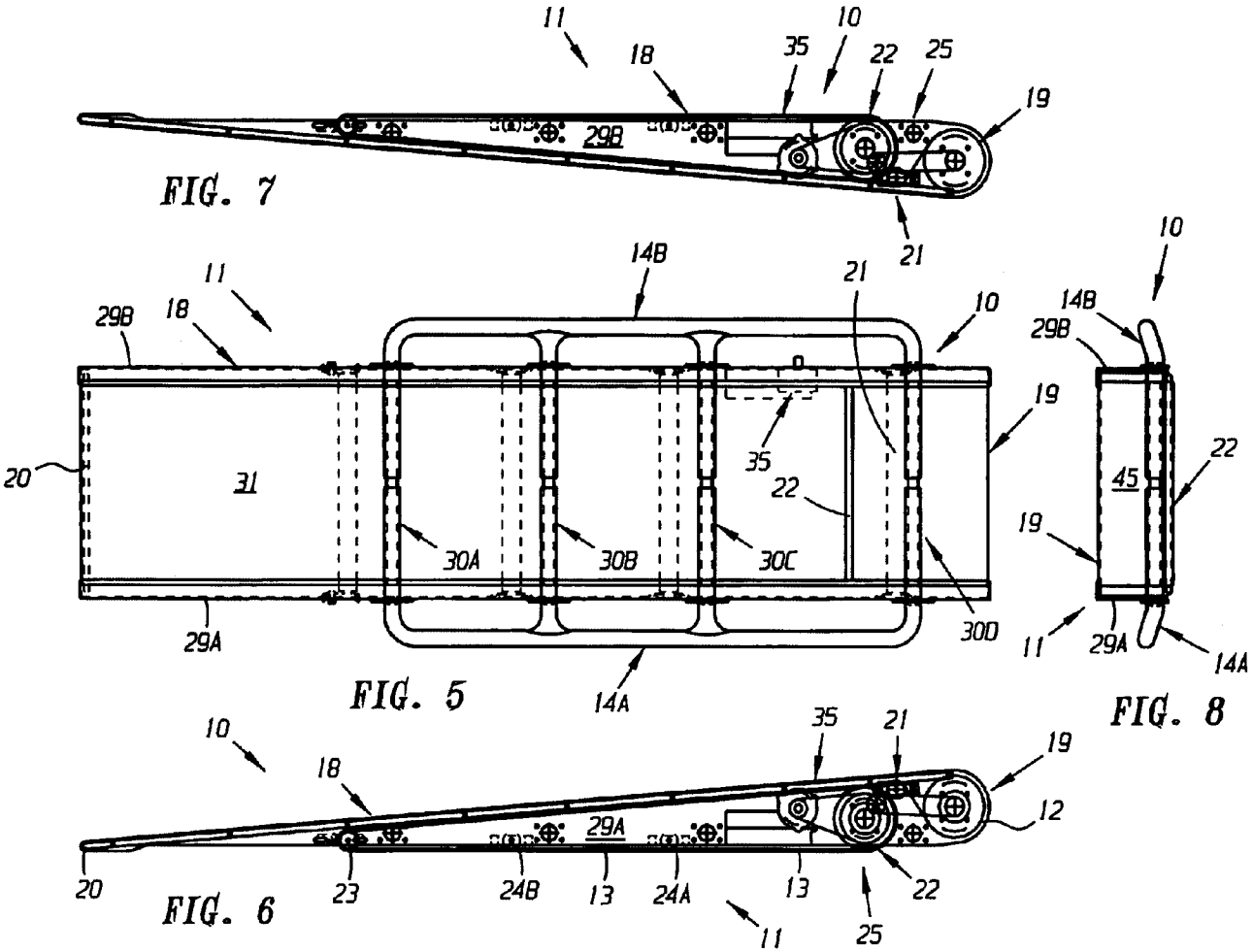
FIG. 5 is a top view of the medical transport apparatus with portions removed for clarity and to show internal structure.
FIG. 6 is a side view of the medical transport apparatus showing some internal parts.
FIG. 7 is an opposite side view of the medical transport apparatus showing some internal parts.
FIG. 8 is an end view of the medical transport apparatus showing some internal parts.
Figure 11:
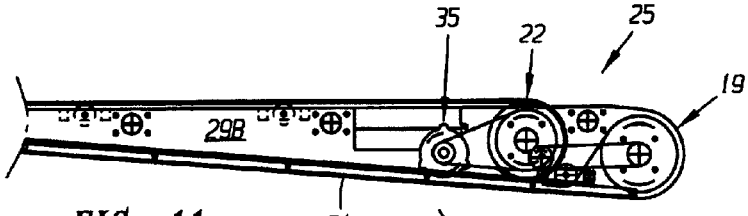
FIG. 11 is an opposite side view of the portion of the medical transport apparatus shown in FIG. 10.
Figure 9:
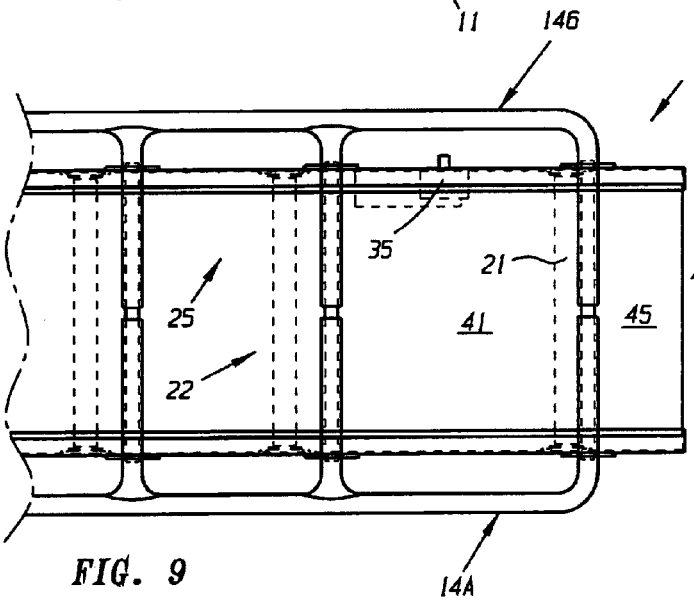
FIG. 9 is a top view of a portion of the medical transport apparatus.
Figure 12:
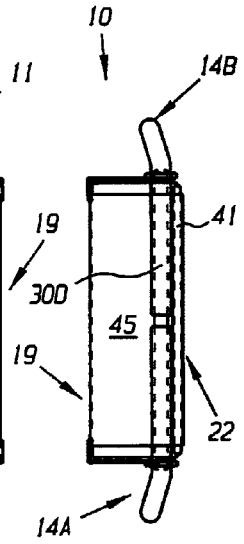
FIG. 12 is an end view of the portion of the medical transport apparatus shown in FIG. 9.
Figure 10:
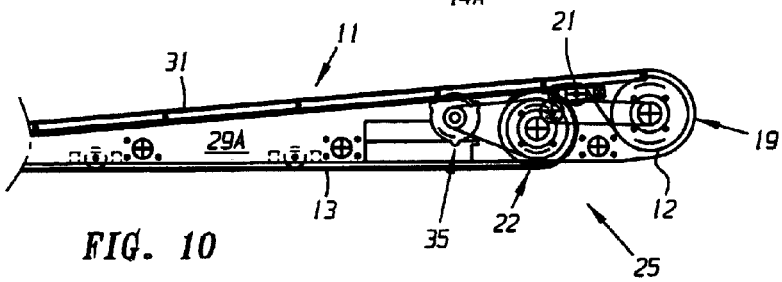
FIG. 10 is a side view of a portion of the medical transport apparatus.
Figures 19, 20:
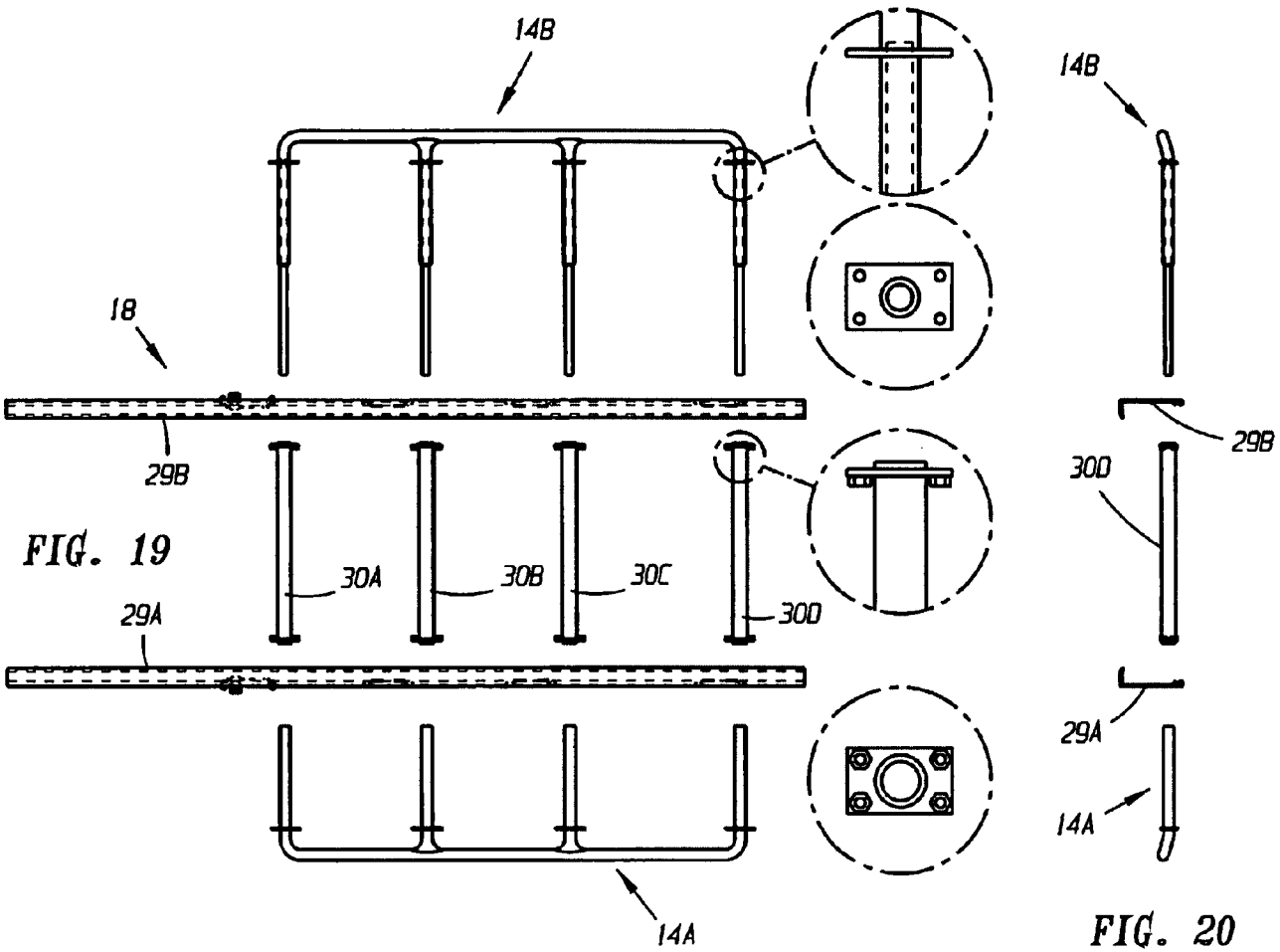
FIG. 19 is a top view of the chassis and handles.
FIG. 20 is an end view of the chassis and handles shown in FIG. 19.

The frame 11 comprises a pair of chassis sides 29*a* and *b*, spacers 30*a*–*d*, and a belt glide bed 31. The frame 11 primarily provides structural support to the remaining elements of the apparatus 10. Referring also to FIGS. 15–18, the chassis sides 29 are longitudinally disposed and have a predetermined configuration and length. The chassis side configuration includes straight sides forming an incline with radius ends. Referring also to FIGS. 19 and 20, the spacers 30 have a predetermined length and are laterally disposed and connect the chassis sides 29. The spacers 30 are disposed parallel to each other a predetermined distance apart from each other. Referring also to FIG. 5, belt glide bed 31 is shown. Preferably, the glide bed 31 is a unitary or one piece structure which is rigidly connected to the chassis sides 29, for example by welding or fabrication. Alternatively, the glide bed 31 may be constructed of plural pieces or may be connected to the chassis sides 29 by known fasteners. The gide bed 31 is preferably flat, but may have a contoured surface.

Figure 13:
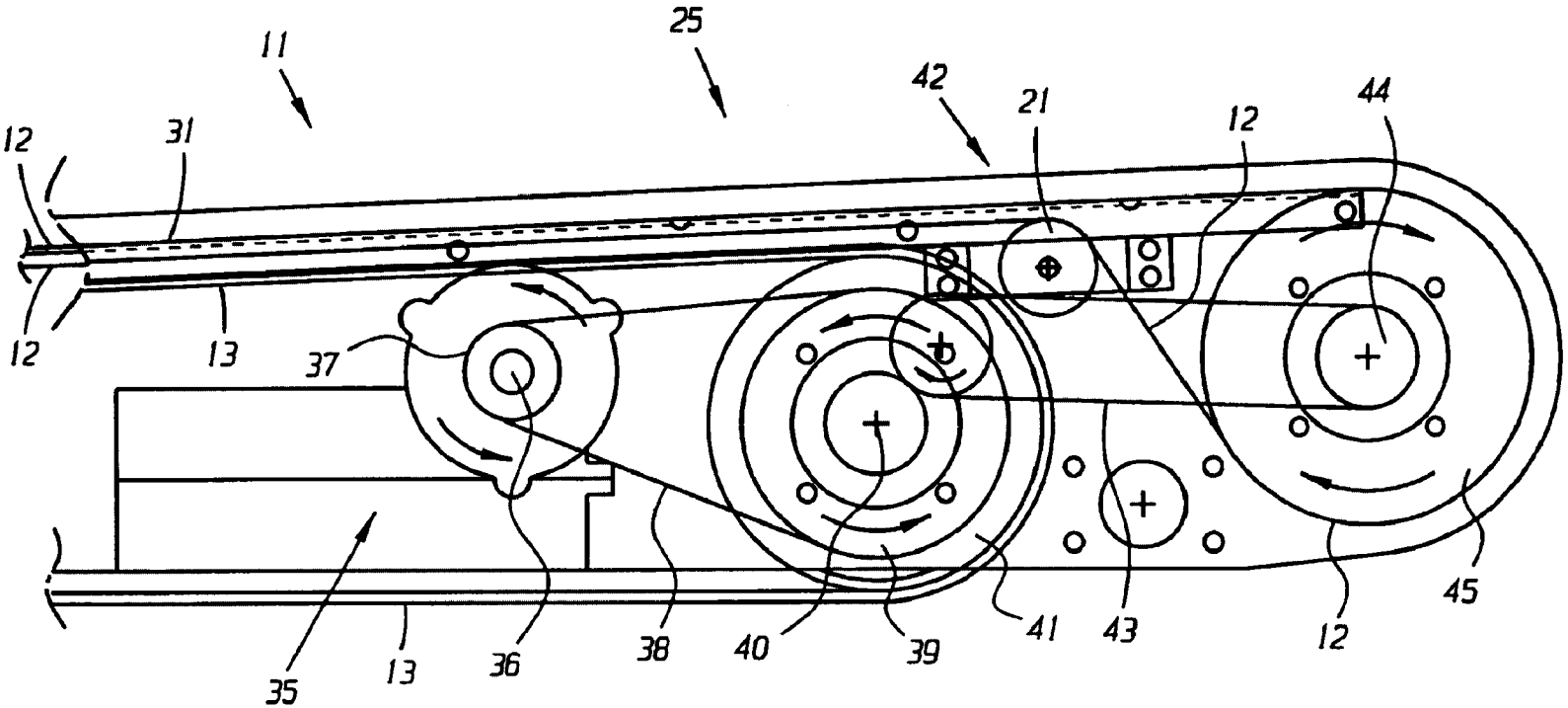
FIG. 13 is an enlarged side view of the portion of the medical transport apparatus shown in FIG. 10.
Figure 14:
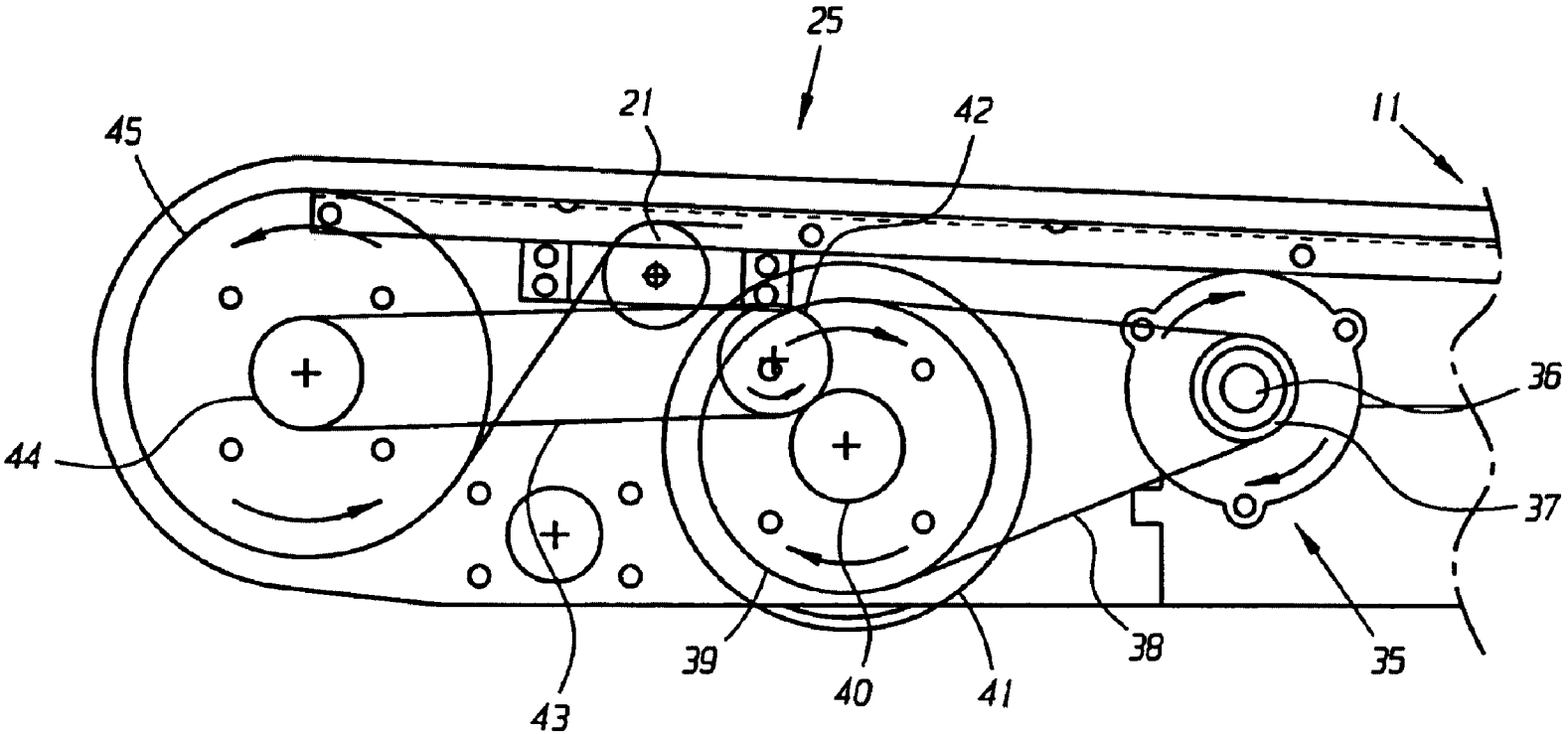
FIG. 14 is an enlarged side view of the portion of the medical transport apparatus shown in FIG. 11.
Figure 17:
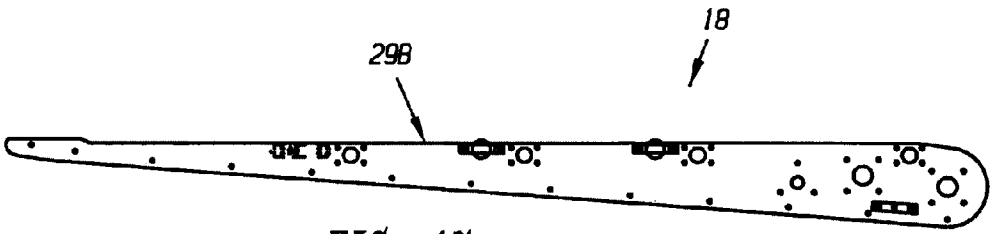
FIG. 17 is a side view of another chassis.
Figure 15:
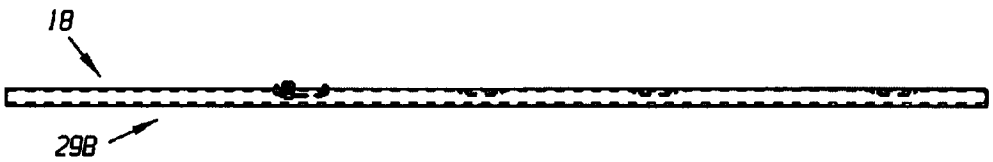
FIG. 15 is a top view of side chassis of the medical transport apparatus.
Figure 16:
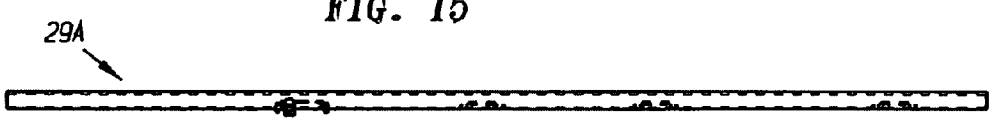
FIG. 16 is a side view of one of the chassis.
Figure 16:
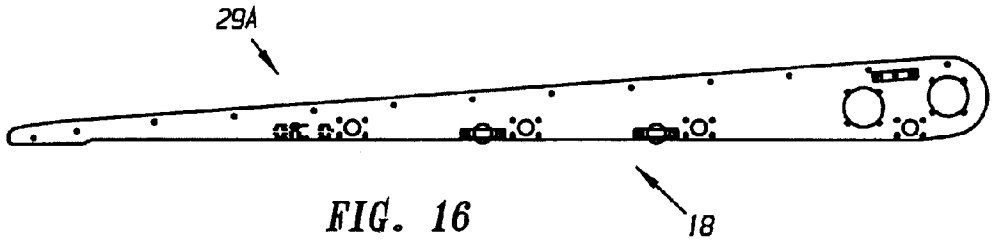
Figure 18:
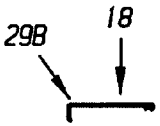
FIG. 18 is an end view of the chassis.
Figure 18:
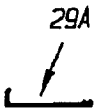

Also as shown in FIGS. 5–8, the upper and lower drive rollers 19 and 22, and hence the belts 12 and 13, are powered by a drive mechanism 25. Referring also to FIGS. 13 and 14, one embodiment of the drive mechanism 25 basically comprises a battery powered motor 35, a first belt 38, and a second belt 43. Motor 35 is preferably an aviation quality, high torque motor. An exemplary motor is provided by Quantum of Minnesota, USA. Motor 35 has power shaft 36 which is connected to motor pulley 37. First belt 38 is communicatively connected to motor pulley 37 and to lower drive pulley 39. Lower drive pulley 39 is connected to and drives first gear 40. First gear 40 is communicatively connected to and drives second gear 42. Second belt 43 communicatively connects second gear 42 to third gear 44. Third gear 44 is communicatively connected to upper drive hub 45. Lower drive roller 22 is connected to lower drive hub 41 which is connected to first gear 40, which thus supplies ground transportation power to lower belt 13. Upper drive roller 19 is connected to upper drive hub 45, which thus supplies patient transportation power to upper belt 12. This drive mechanism 25 configuration permits synchronized powering of both the upper and lower belts 12 and 13 via the single motor 35. These drive mechanism 25 components are disposed internally, between the chassis sides 29*a* and *b* of the frame 18. The drive mechanism components essentially define a transmission connecting the motor 35 to the upper and lower drive rollers 19 and 22.

Figure 21:
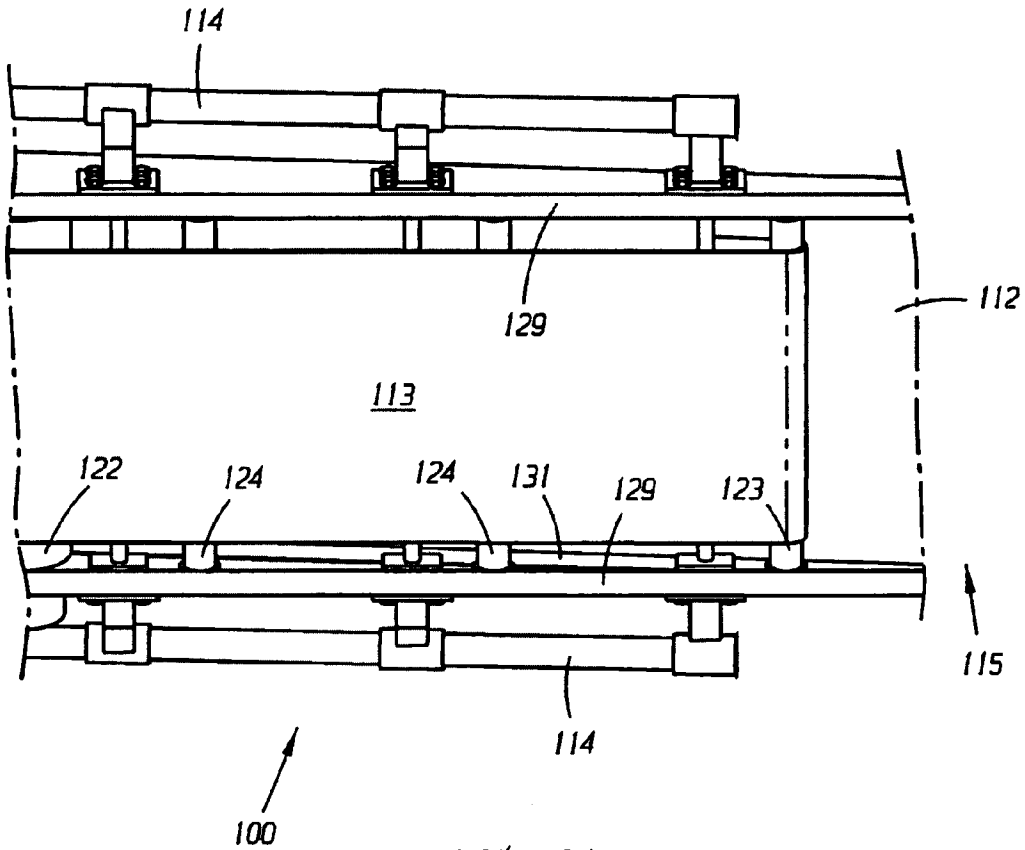
FIG. 21 is a bottom plan view of a portion of the medical transport apparatus embodiment of FIG. 1.
Figure 22:
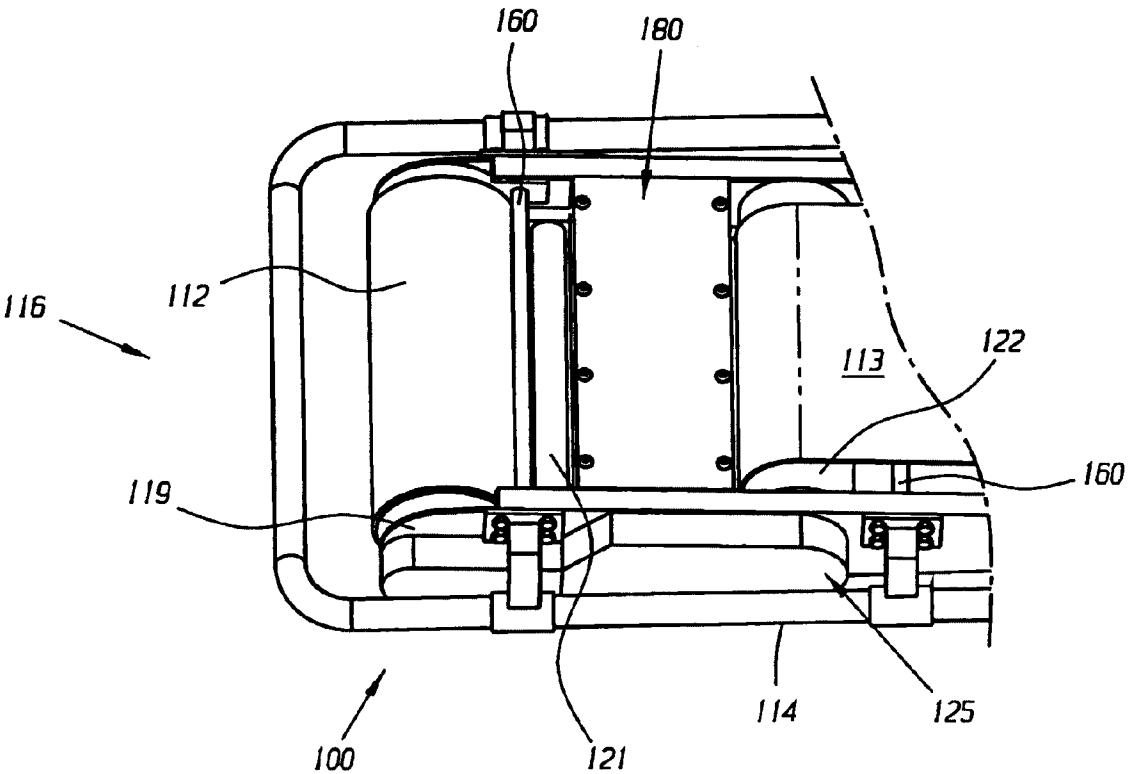
FIG. 22 is a view of another portion of the apparatus embodiment of FIG. 21.
Figure 23:
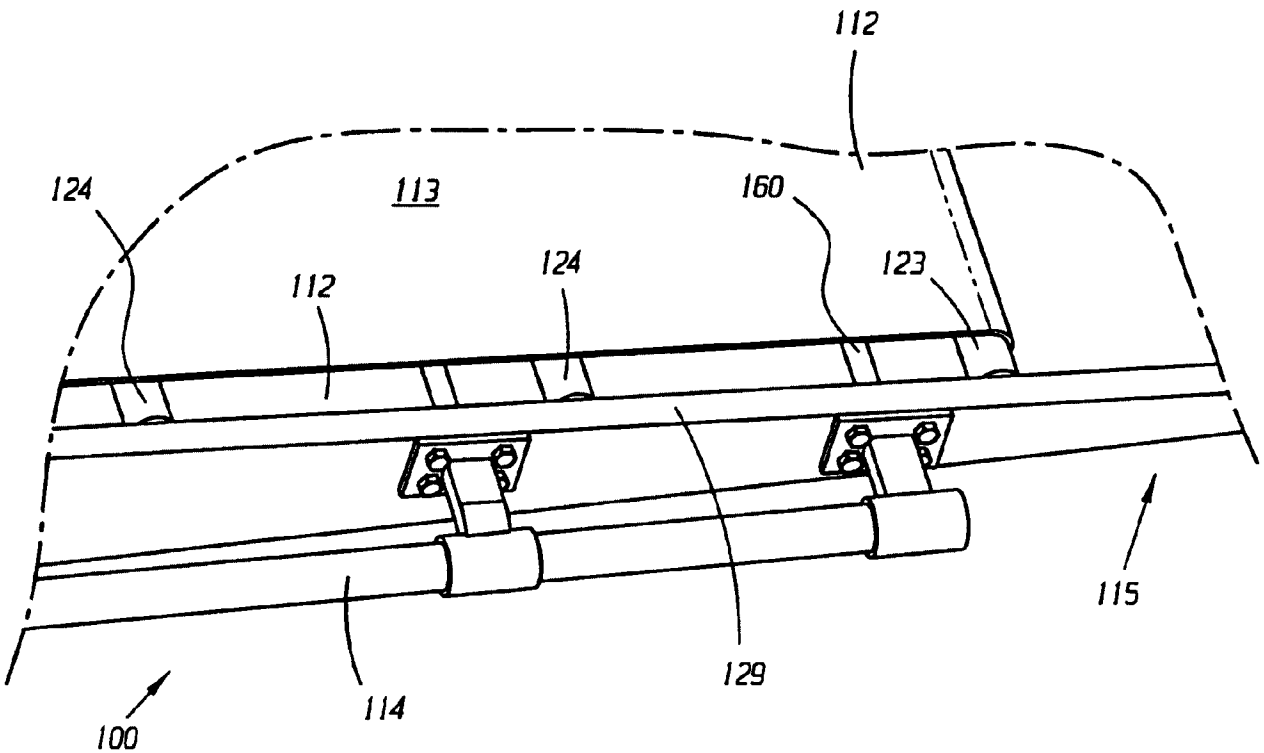
FIG. 23 is a view of another portion of the apparatus embodiment of FIG. 22.

Referring to FIGS. 21–23, an alternative embodiment of the apparatus 110 is shown which has a substantially similar structure and function to the apparatus 10. Elements or aspects of apparatus 110 which have a structure or function substantially similar to elements or aspects of apparatus 10 have the same numerical designation except that is a one hundred series (100) number. In other words, for example, upper or top belt 112 in device 100 is substantially similar to top belt 12 of device 10.

Figure 24:
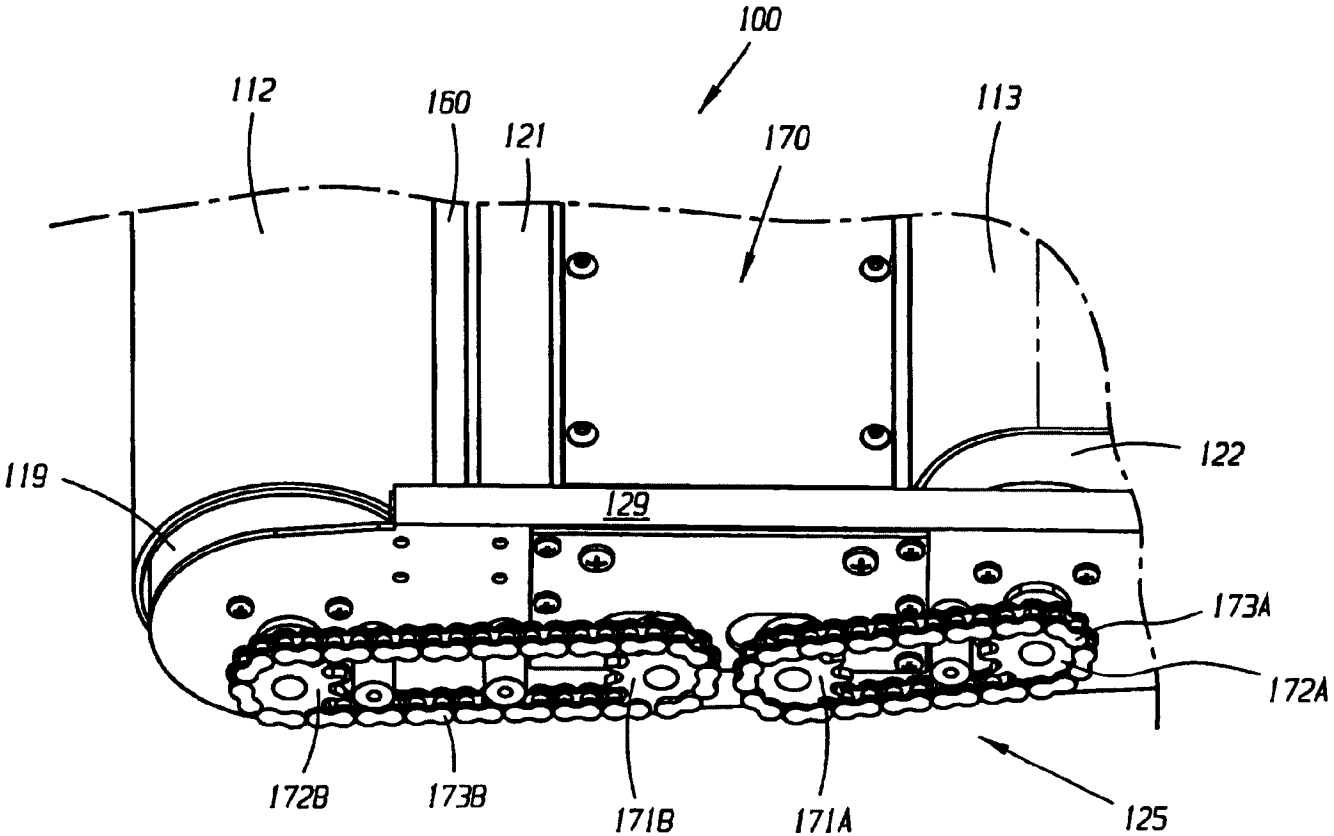
FIG. 24 shows a portion of the drive mechanism of the apparatus embodiments of FIGS. 21–23.
Figure 25:
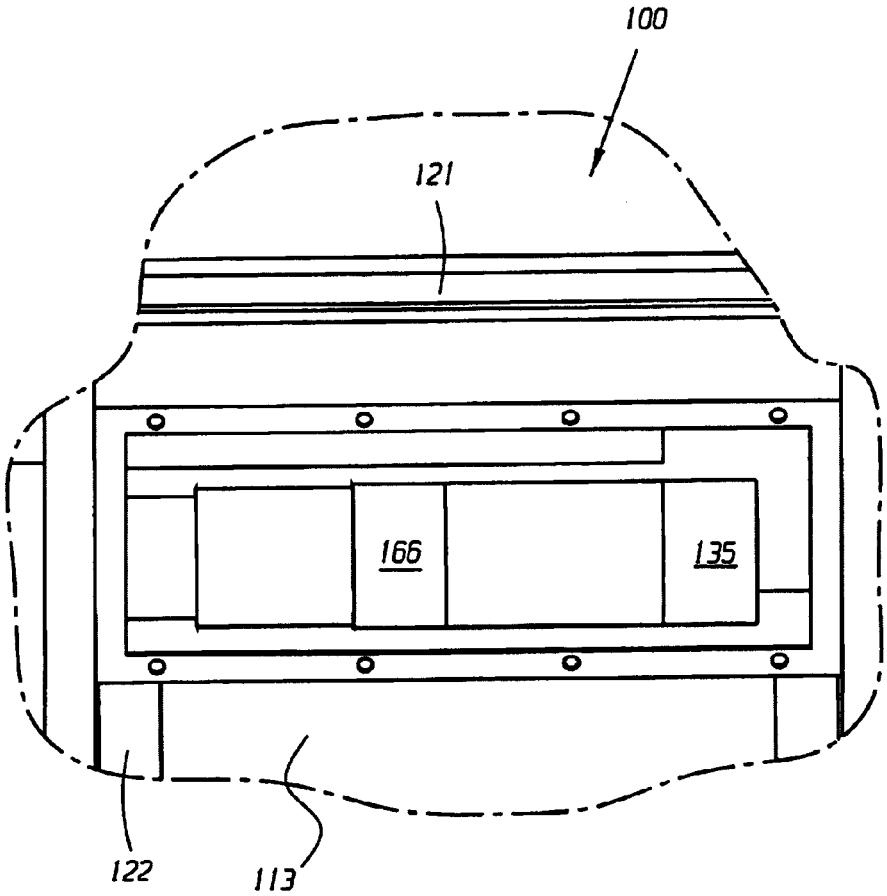
FIG. 25 shows an embodiment of motors of the drive mechanism of the apparatus.

Apparatus 110 has rigid, linear, lateral stabilizers 160. Referring also to FIGS. 24 and 25, drive mechanism 125 includes a battery system 164, a control circuit 165, a high torque motor 135 and a gear box 166 connected to the motor 135, both of which are covered by housing cover 170. The gear box 166 is preferably a planetary-type gear box which is connected to the motor 135 and converts the motor drive speed to a prefered drive speed of approximately 10 RPM. Gear box 166 has a drive shaft/sprocket set 171*a*. Shaft/sprocket set 171*b* is driven by drive shaft/sprocket set 171*a* via a pair of gears (not shown) connected to shafts 171*a* and *b* and an intermediary gear (not shown). Drive shaft sprocket/shaft set 171*a* is communicatively connected to roller sprocket/shaft combination 172*a* (coupled to lower drive roller 122) via drive chain 173*a*. Shaft/sprocket set 171*b* is coupled to roller sprocket/shaft combination 172*b* (coupled to upper drive roller 119) via drive chain 173*b*. This permits synchronized driving of the lower and upper belts 113 and 112. Alternatively, plural motors may be used or the belts may be driven at different speeds.

Figure 26A:
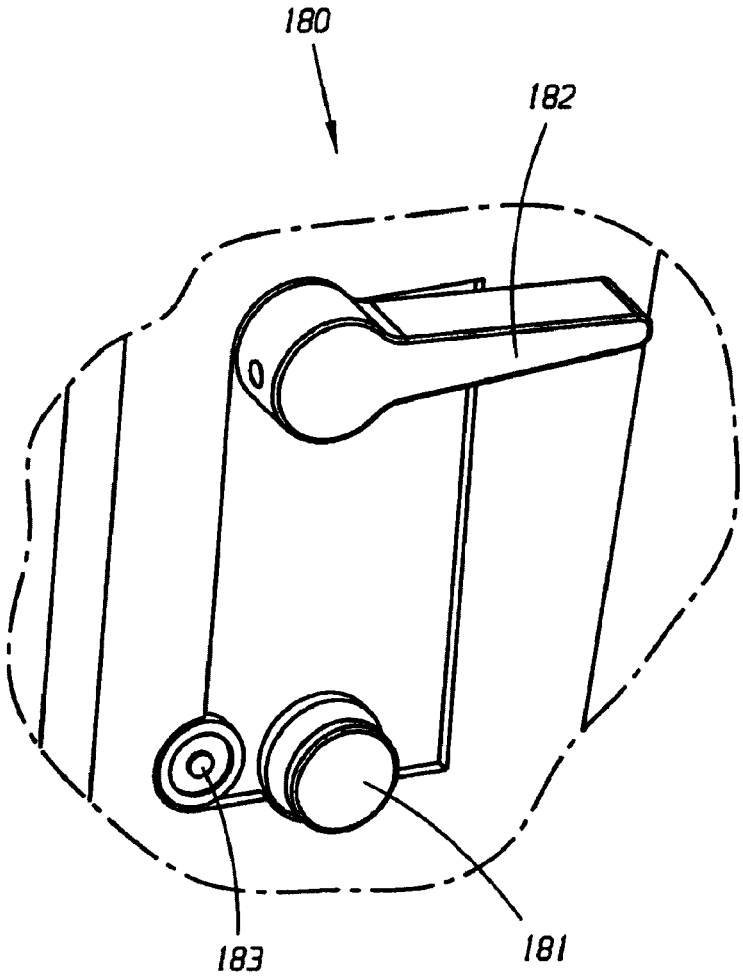
FIGS. 26*a* and *b* show an embodiment of the control panel of the apparatus.
Figure 26B:
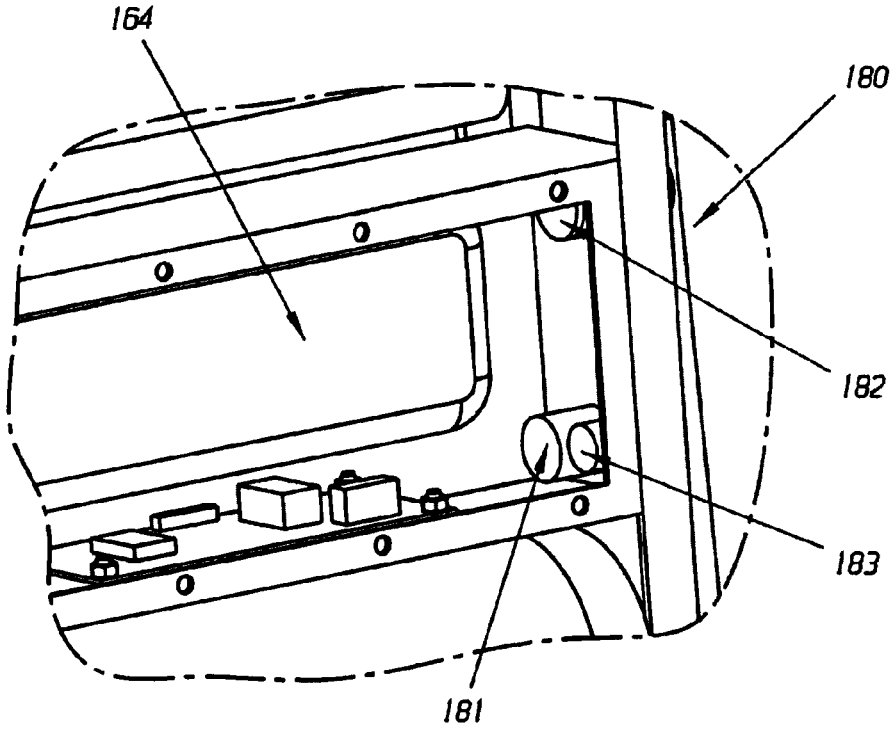
Figure 27:
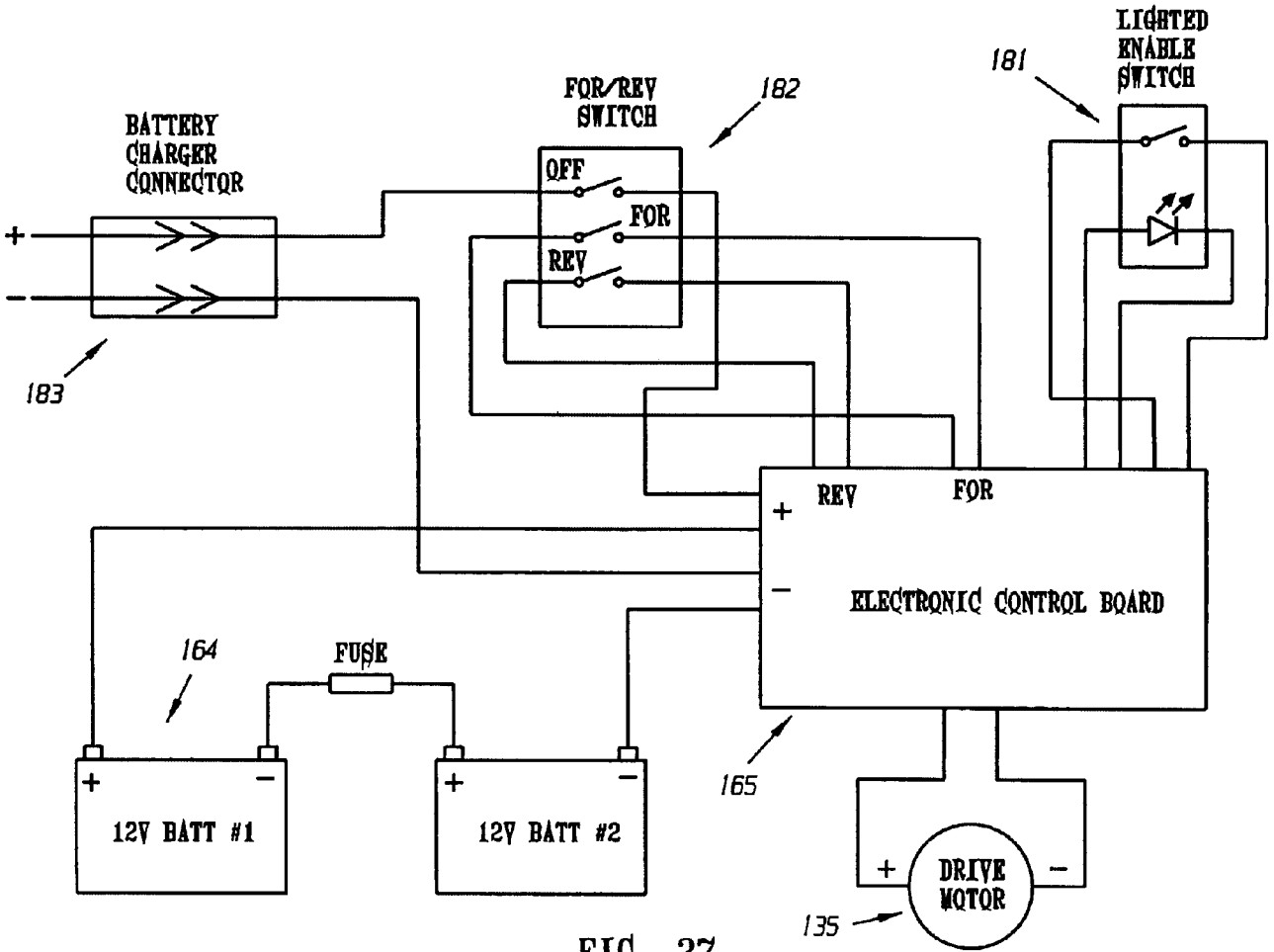
FIG. 27 is a schematic illustration of one embodiment of the control system of the apparatus.

FIGS. 26*a* and *b* show control panel 180 comprising an on/off switch 181, an actuation control lever 182 and a battery recharger receptacle 183. On/off switch 181 preferably has a built in indicator light. Actuation control lever 182 is rotatable in forward and reverse directions corresponding to forward and reverse directions for the apparatus. Lever 182 preferably automatically returns to a neutral position when released by the user. Preferably, the control system has a lag period of a predetermined time, most preferably approximately 5 seconds, whereby when the user moves the lever the system powers up from 0 speed to the predetermined maximum speed (for example 0.133 feet per second) over the lag period. Acceleration is preferably substantially linear. Also, when the lever is released by the user, the system slowly powers down from the normal travel speed to a stop. This smooths transitions and loading, prevents sudden stops, and minimizes trauma. Preferably, the system can be suddenly stopped in an emergency by moving the lever from one direction to the opposite direction. FIG. 27 is a schematic illustration of one embodiment of control circuitry of the apparatus 10.

Although the device and method shown and described above is configured as a stretcher, it is within the purview of the invention that the device could be configured as a guerney, for example with legs. Additionally, although the device and method are shown and described for use with respect to an injured human being, they can be used for non-injured humans, injured or non-injured animals other than humans such as in a veteinary medical setting, and non-animal objects such as in a materials handling setting.

The descriptions above and the accompanying drawings should be interpreted in the illustrative and not the limited sense. While the invention has been disclosed in connection with an embodiment or embodiments thereof, it should be understood that there may be other embodiments which fall within the scope of the invention as defined by the claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

The invention claimed is:

1. A device for acquiring and transporting an object, comprising:

a. a housing having a low clearance portion;

b. a first conveyance assembly movably connected to the housing for moving the housing with respect to an environmental surface, wherein the first conveyance assembly comprises a lower drive roller connected to the housing and to the power assembly, a lower end idler roller connected to the housing, and a lower endless belt movably coupled to the lower drive roller and the lower end idler roller;

c. a second conveyance assembly movably connected to the housing for moving the object with respect to the housing, wherein the second conveyance assembly comprises an upper drive roller connected to the housing and to the power assembly, an upper end idler roller connected to the housing, and an upper endless belt movably coupled to the upper drive roller and the upper end idler roller; and d. a power assembly for moving the conveyance assemblies, wherein the power assembly comprises a battery, a motor communicatively connected to the battery, a transmission connected to the motor, to lower drive roller and to the upper drive roller, and an electronic control system communicatively connected to the motor and to the battery, the transmission having first and second power shafts connected to first and second power sprockets respectively, a first drive chain communicatively connecting the first power sprocket to a lower sprocket on the lower drive roller, and a second drive chain communicatively connecting the second power sprocket to an upper sprocket on the upper drive roller.

2. The device of claim 1, wherein the object is an injured human being.

3. The device of claim 1, wherein the device is configured as a stretcher.

4. The device of claim 1, wherein the device is configured as a guerney.

5. The device of claim 1, wherein the housing is a frame for supporting the first and second conveyance mechanisms and the power assembly.

6. The device of claim 5, wherein the frame comprises a pair of chassis sides and a plurality of spacers connecting the chassis sides.

7. The device of claim 6, wherein the frame further comprises a belt glide bed connected to the chassis sides.

8. The device of claim 5, wherein the housing further comprises a handle for lifting the device.

9. The device of claim 1, wherein the second conveyance assembly further comprises at least one tensioning idler roller connected to the housing, disposed between the upper drive roller and the upper end idler roller and engaging the upper endless belt.

10. The device of claim 1, wherein the first conveyance assembly further comprises at least one support idler roller connected to the housing, disposed between the lower drive roller and the lower end idler roller and engaging the lower endless belt.

11. The device of claim 1, further comprising a control system communicatively connected to the power assembly.

12. A low profile, powered stretcher for acquiring and transporting an injured human being, comprising:

a. a housing having a low clearance portion, the housing including a pair of chassis sides and a plurality of spacers connecting the chassis sides;

b. a first conveyance assembly movably connected to the housing for moving the housing with respect to an environmental surface, the first conveyance assembly including a lower drive roller connected to the housing and to the power assembly, a lower end idler roller connected to the housing, and a lower endless belt movably coupled to the lower drive roller and the lower end idler roller, the lower endless belt moving in a first rotational direction;

c. a second conveyance assembly movably connected to the housing for moving the object with respect to the housing, the second conveyance assembly including an upper drive roller connected to the housing and to the power assembly, an upper end idler roller connected to the housing, and an upper endless belt movably coupled to the upper drive roller and the upper end idler roller, the upper endless belt moving in a second rotational direction which is opposite the first rotational direction;

d. a power assembly for moving the conveyance assemblies, the power assembly including a battery, a motor communicatively connected to the battery, a transmission connected to the motor, to lower drive roller and to the upper drive roller, and an electronic control system communicatively connected to the motor and to the battery, the transmission having first and second power shafts connected to first and second power sprockets respectively, a first drive chain communicatively connecting the first power sprocket to a lower sprocket on the lower drive roller, and a second drive chain communicatively connecting the second power sprocket to an upper sprocket on the upper drive roller;

e. an actuation control lever communicatively connected to the control system, the control lever being manually rotatable by a user in a forward and a reverse direction corresponding to forward and reverse directions of movement of the stretcher, the control lever being biased to return to a neutral position upon manual release by the user, whereby upon manual release of the control lever the power assembly decelerates the stretcher to a stop; and f. wherein the control system provides a lag period of a predetermined time for accelerating the stretcher from 0 speed to a maximum speed and for decelerating the stretcher from the maximum speed to 0 speed whereby the stretcher accelerates and decelerates smoothly and avoids sudden starts and stops to minimize trauma to the transported injured human being.

13. The device of claim 12, wherein the lag period time is 5 seconds.

14. The device of claim 12, wherein acceleration and deceleration is linear.

15. The device of claim 12, wherein the maximum speed is 0.133 feet per second.

* * * * *